US007426783B2

(12) United States Patent
Ito et al.

(10) Patent No.: US 7,426,783 B2
(45) Date of Patent: Sep. 23, 2008

(54) METHOD OF MANUFACTURING AN INK JET HEAD

(75) Inventors: Atsushi Ito, Owariasahi (JP); Yasuo Okawa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 288 days.

(21) Appl. No.: 11/275,339

(22) Filed: Dec. 27, 2005

(65) Prior Publication Data

US 2006/0137180 A1 Jun. 29, 2006

(30) Foreign Application Priority Data

Dec. 27, 2004 (JP) ..... 2004-376220

(51) Int. Cl.
*B21D 53/76* (2006.01)

(52) U.S. Cl. ..... 29/890.1; 29/830; 29/DIG. 37; 347/44; 347/45; 156/234; 156/239

(58) Field of Classification Search ..... 29/890.1, 29/896.6, 830, 432, DIG. 37; 156/234, 239; 347/44, 45, 47, 71

See application file for complete search history.

(56) References Cited

U.S. PATENT DOCUMENTS

| | | | | |
|---|---|---|---|---|
| 5,189,437 | A | 2/1993 | Michaelis et al. | |
| 5,376,204 | A * | 12/1994 | Amano | 156/234 |
| 5,643,379 | A * | 7/1997 | Takeuchi et al. | 347/71 X |
| 6,808,251 | B2 | 10/2004 | Hiwatashi et al. | |
| 2001/0033309 | A1 | 10/2001 | Daddey | |
| 2003/0167637 | A1 | 9/2003 | Maeda et al. | |

FOREIGN PATENT DOCUMENTS

| | | | | |
|---|---|---|---|---|
| EP | 0858893 | | 9/1997 | |
| JP | 5-124199 | * | 5/1993 | 347/45 |
| JP | 1999179900 | A | 7/1999 | |
| JP | H11-179900 | A | 7/1999 | |
| JP | 2000-289211 | * | 10/2000 | |
| JP | 2004-122422 | A | 4/2004 | |

* cited by examiner

*Primary Examiner*—A. Dexter Tugbang
(74) *Attorney, Agent, or Firm*—Baker Botts L.L.P.

(57) ABSTRACT

In order to avoid any positional misalignment between an ink passage hole formed on a manifold plate and a nozzle formed on a nozzle plate, the nozzle plate on which no nozzle has been formed, is stacked on and bonded to the manifold plate having the ink passage hole. After the nozzle plate is bonded to the manifold plate, the nozzle is formed on the nozzle plate. Then, a water-repellent film is formed on an ink-discharging surface of the nozzle plate. Further, a cavity plate or the like is bonded to the manifold plate and an ink jet head is completed.

6 Claims, 8 Drawing Sheets

METHOD OF MANUFACTURING AN INK JET HEAD

CROSS-REFERENCE TO RELATED APPLICATION

This application claims priority to Japanese Patent Application No. 2004-376220 filed on Dec. 27, 2004, the contents of which are hereby incorporated by reference into the present application.

BACKGROUND OF THE INVENTION

1. Field of the Invention

The present invention relates to a method of manufacturing an inkjet head.

2. Description of the Related Art

A method of manufacturing an inkjet head by bonding a nozzle plate having nozzles to a plate having ink passage holes is known.

Japanese Laid-Open Patent Application Publication No. 2003-205610 describes an inkjet head manufactured by this method. In this inkjet head, a nozzle plate having nozzles is stacked onto a plate having ink passage holes, and the each of ink passage holes is communicated with a uniquely corresponding nozzle. The plate having ink passage holes and the nozzle plate having nozzles are bonded by an adhesive.

In the above method, it is necessary to accurately align the plate having ink passage holes with the nozzle plate having nozzles before bonding them together. Since each of the ink passage holes and each of the nozzles are minute, it is difficult to accurately align the two plates.

Furthermore, the method that uses the adhesive to bond the plate having ink passage holes to the nozzle plate having nozzles generates a risk that the adhesive may flow into ink passage holes or nozzles. If the adhesive flows into the nozzle, it alters the nozzle diameter, thereby lowering a print quality. A nozzle may even become blocked by the adhesive. If the adhesive flows into the ink passage holes, it hinders the flow of ink inside the ink passage holes.

Japanese Laid-Open Patent Application Publication No. H11-179900 discloses a technique that stacks a metal plate having ink passage holes and a metal nozzle plate having nozzles, and diffusion-bonds the metal plate having ink passage holes and the metal nozzle plate having nozzles by placing the stacked body inside a vacuum chamber and pressurizing the stacked body in the stacking direction at a high temperature. This manufacturing method can eliminate the problem of an adhesive flowing into the nozzles or ink passage holes.

BRIEF SUMMARY OF THE INVENTION

However, even with the inkjet head manufacturing method described in Japanese Laid-Open Patent Application Publication No. H11-179900, it is still necessary to accurately align the plate having ink passage holes with the nozzle plate having nozzles. As each of ink passage holes and each of nozzles are becoming increasingly finer, it is becoming difficult to accurately align the two plates.

The object of the present invention is to provide a technique that, when bonding a plate having at least one ink passage hole (hereafter may be referred to as "a first plate") to a nozzle plate having at least one nozzle (hereafter may be referred to as "a second plate"), does not require accurate alignment between the first plate and the second plate. The object of the present invention is to provide an inkjet head manufacturing method that can connect each of ink passage holes to a uniquely corresponding nozzle without aligning the first plate with the second plate.

A method of manufacturing an inkjet head according to this invention has steps of bonding a surface of a first plate having at least one ink passage hole penetrating the first plate to a surface of a second plate, and forming at least one throughhole penetrating the second plate. The step of forming the throughhole is performed subsequent to the step of bonding the first plate and the second plate. The throughhole is formed such that it is communicated with the ink passage hole at a contact face between the first plate and the second plate and the throughhole opens at an ink-discharging surface that is opposite the contact face. In a case that the second plate has a plurality of ink passage holes, a plurality of throughholes is formed such that each of throughholes is communicated with a uniquely corresponding ink passage hole.

In the above method, the nozzle is formed by forming the throughhole in the second plate. In the method, the first plate and the second plate are bonded together before the nozzle is formed. Since the second plate is bonded to the first plate before the nozzle is formed on the second plate, there is no need to align the two plates when bonding them together.

In the method, the nozzle is formed on the second plate after it is bonded to the first plate. In the nozzle forming process, it is possible to form the nozzle on the second plate while checking the position of the ink passage hole in the first plate. Therefore, the nozzle can be easily formed at the position on the second plate that matches the position of the ink passage hole in the first plate.

BRIEF DESCRIPTION OF THE DRAWINGS

FIG. 8 (*b*) shows a process of driving a punch into a nozzle plate through a second ink passage hole of the second manifold plate. FIG. 8 (*c*) shows a process of removing a protrusion formed on the ink-discharging surface.

FIG. 9 (*a*) shows a process of applying a photo-curing resin to the ink-discharging surface. FIG. 9 (*b*) shows a process of curing the photo-curing resin inside a nozzle. FIG. 9 (*c*) shows a process of removing the photo-curing resin on the ink-discharging surface except for a pillar-shaped cured portion.

FIG. 9 (*d*) shows a process of forming a water-repellent film on the ink-discharging surface. FIG. 9 (*e*) shows a process of removing the pillar-shaped cured portion.

DETAILED DESCRIPTION OF THE INVENTION

Figure 1:
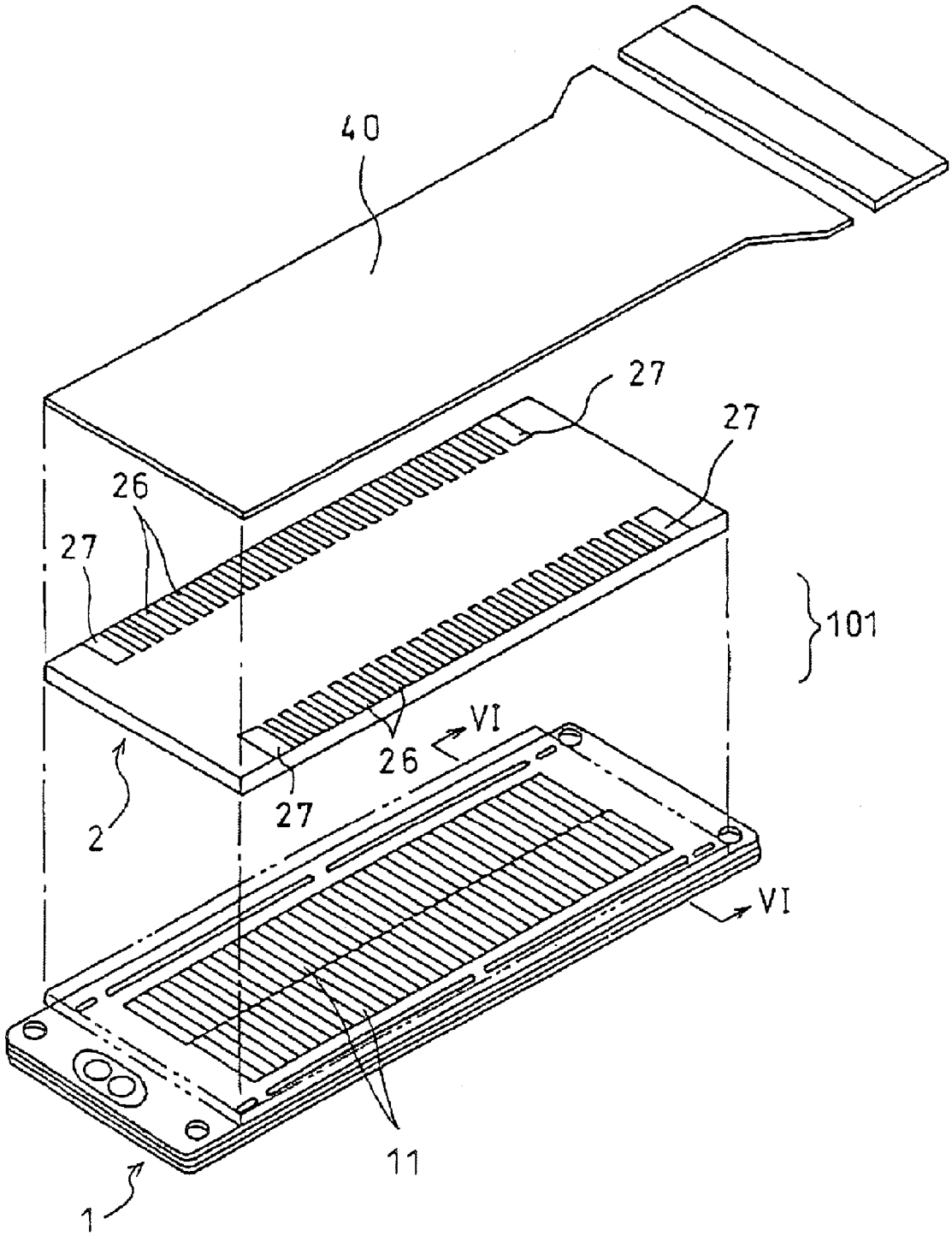
FIG. 1 is an exploded perspective view of an inkjet head in an embodiment.

It is preferred that the throughhole-forming step has a step of driving a punch into the second plate through the ink passage hole so that a protrusion is formed at the ink-discharging surface, and a step of removing the protrusion formed at the ink-discharging surface. The punch is driven into the second plate until the tip of the punch proceeds beyond the ink-discharging surface and stopped before the second plate is broken and the throughhole is formed on the second plate. The throughhole is formed by removing the protrusion.

By driving the punch into the second plate through the ink passage hole in the first plate, it is possible to form the nozzle at the position on the second plate that matches the position of the ink passage hole in the first plate. Since the nozzle is formed by driving the punch in, the nozzle with a smooth interior surface can be formed. The nozzle can also be formed with a precise internal diameter.

The punch is driven until its tip goes past the ink-discharging surface. However, the punch is stopped before its tip passes through the second plate and forms the throughhole in the second plate. Since the punch is driven until its tip goes past the ink-discharging surface, thereby the protrusion is formed at the ink-discharging surface. Therefore, removing the protrusion can form the hole opening at the ink-discharging surface of the second plate. Since the tip of the punch does not go through the second plate, the interior surface of the nozzle becomes smooth. If the punch goes through the second plate, jaggies might be created in the perimeter of the formed opening. If jaggies are created in the perimeter of the opening, there is a risk that jaggies might remain inside the opening even if the ink-discharging surface of the second plate is planarized, for example. Driving the punch such that its tip does not go through the second plate and removing the formed protrusion can form the nozzle that is smooth all the way to its opening.

It is preferred that the first plate and the second plate are bonded together by pressurizing a stack of the first plate and the second plate in its thickness direction at a predetermined temperature that is higher than a room temperature. Herein the room temperature is typically about 25 Celsius degree.

According to this bonding method, there is no need to use an adhesive to bond the first plate and the second plate. Therefore, there is no adhesive that could flow into the ink passage hole in the first plate, as is the case with the inkjet head disclosed in Japanese Laid-Open Patent Application Publication No. 2003-205610.

It is preferred that a water-repellent film be formed on the ink-discharging surface. The water-repellent film may be applied subsequent to forming the throughhole.

Forming a water-repellent film on the ink-discharging surface can prevent ink from the nozzle from adhering to the ink-discharging surface. If an adhesive is used to bond the first plate and the second plate, and if heat treatment is necessary for forming a water-repellent film, there is a risk that the heat treatment of the water-repellent film might weaken the adhesive. The present invention bonds the first plate and the second plate by pressurizing them at a predetermined temperature. That is, the first plate is bonded to the second plate without using an adhesive. Therefore, there is no problem of heat treatment during the formation of the water-repellent film weakening the adhesive. Furthermore, since the water-repellent film is formed on the second plate after the first plate is bonded to the second plate, the heat that is applied during the process of bonding the first plate and the second plate will not destroy the water-repellent film.

According to the method, the water-repellent film can be formed of a material whose maximum temperature tolerance is lower than the predetermined temperature for bonding.

The water-repellent film is formed on the second plate after the first plate is bonded to the second plate. Therefore, even when the first plate and the second plate are heated to the predetermined temperature and bonded together, that predetermined temperature will not affect the formation of the water-repellent film. Even if the water-repellent film is formed of a material whose maximum temperature tolerance is lower than the predetermined temperature, tile predetermined temperature will not destroy the water-repellent film.

A preferred embodiment of the present invention will be explained, referencing the attached drawings.

FIG. 1 is an exploded perspective view of inkjet head 101 of the embodiment. The area indicated by the two-dot-chain lines in FIG. 1 is the region where actuator unit 2 will be positioned. Inkjet head 101 is used in an inkjet printer that prints letters and images on a printing medium by discharging ink.

As shown in FIG. 1, inkjet head 101 has passage unit 1 and actuator unit 2 stacked together. Passage unit 1 is bonded to a bottom surface of actuator unit 2 as viewed in FIG. 1. A plurality of pressurizing chambers 11 is provided at a top portion of passage unit If, These pressurizing chambers 11 will be described below.

Flexible flat cable 40 is bonded to a top surface of actuator unit 2 as viewed in FIG. 1. Flexible flat cable 40 is a cable for electrically connecting actuator unit 2 with a control device provided in the inkjet printer. Connection terminals 26 and 27 are provided on the top surface of actuator unit 2. These connection terminals 26 and 27 will be described below.

Figure 2:
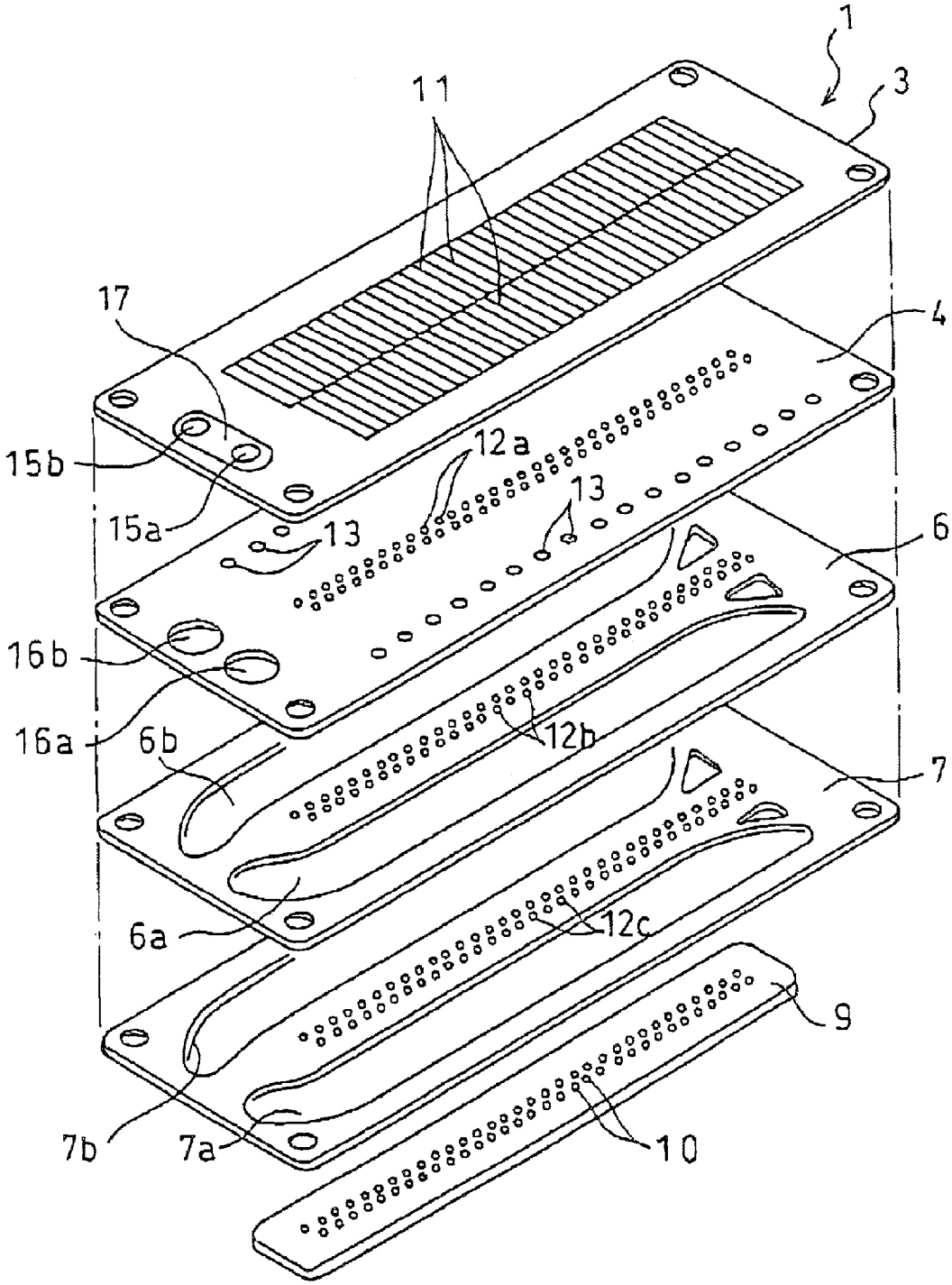
FIG. 2 is an exploded perspective view of a passage unit of the inkjet head in the embodiment.
Figure 3:
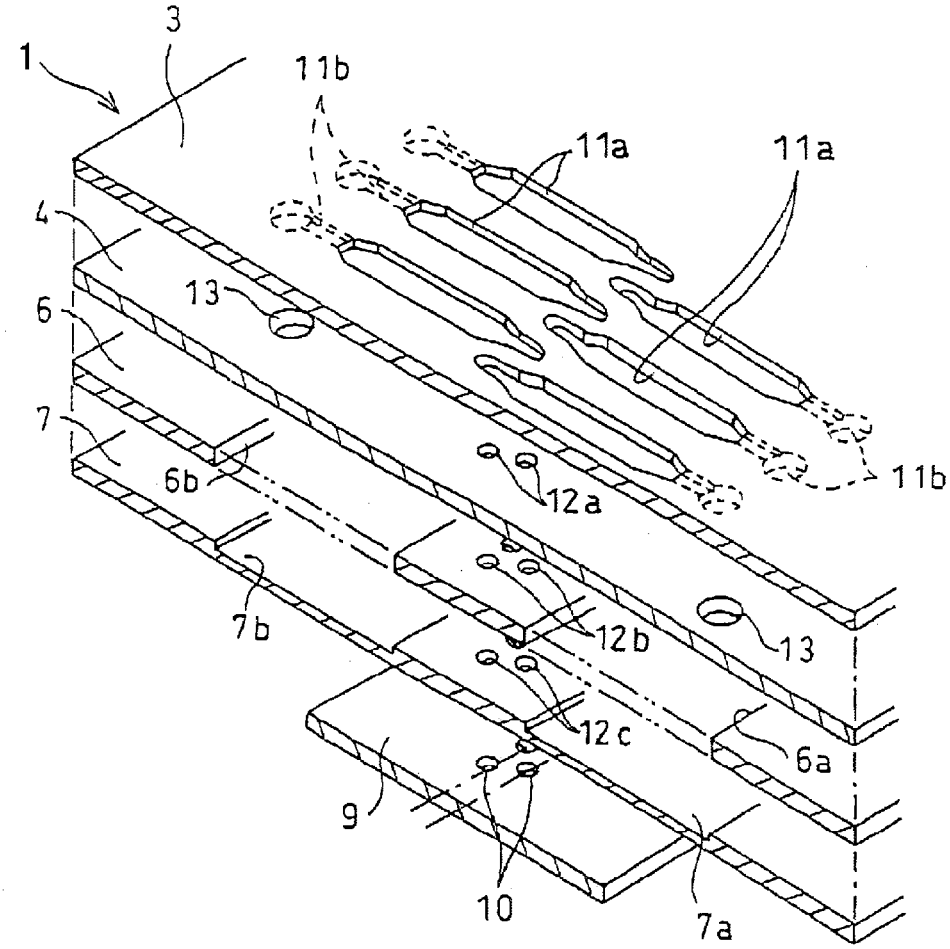
FIG. 3 is a partial enlarged view of the passage unit in FIG. 2.
Figure 4:
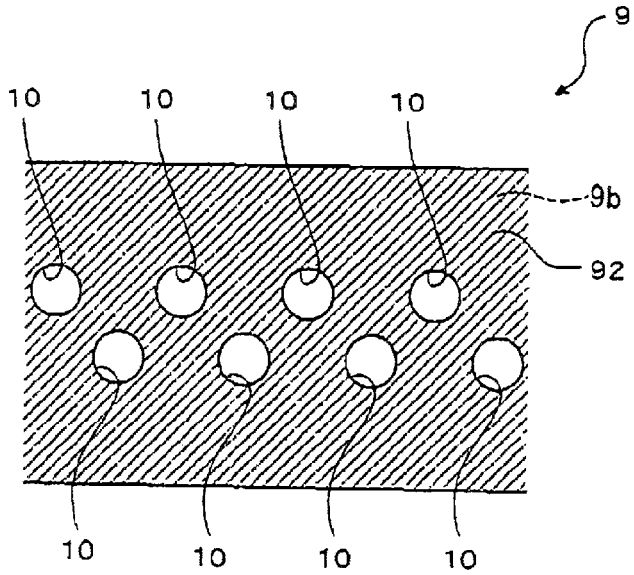
FIG. 4 is a partial plan view of an ink-discharging surface of a nozzle plate in the embodiment.
Figure 6:
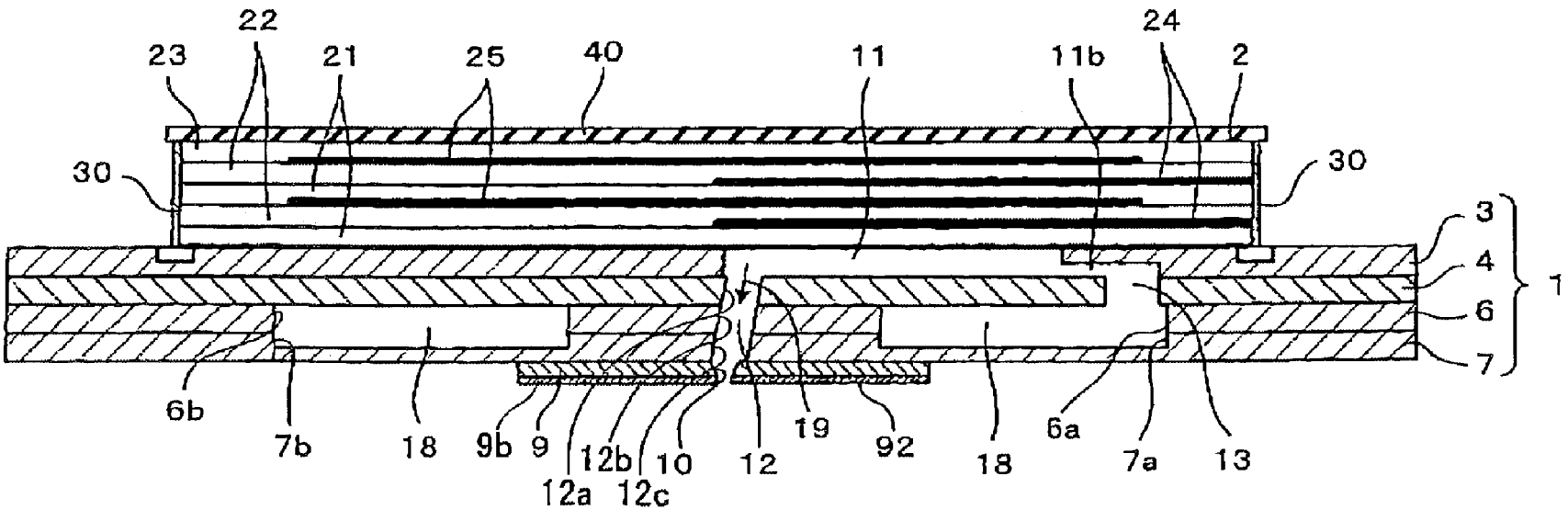
FIG. 6 is a cross-sectional view of the inkjet head taken along line VI-VI in FIG. 1.

Next, passage unit 1 will be explained, referencing FIGS. 2, 3, 4, and 6. FIG. 2 is an exploded perspective view of passage unit 1. FIG. 3 is a partial enlarged view of FIG. 2. FIG. 4 is a partial plan view of ink-discharging surface 9*b* of nozzle plate 9. FIG. 6 is a cross-sectional view of inkjet head 101 taken along line VI-VI in FIG. 1. As will be described below, passage unit 1 has manifold 18 (see FIG. 6) within passage unit 1. Ink is supplied from an ink tank not shown in the drawings to manifold 18.

As will be described below, passage unit 1 has a plurality of ink passages 19. Each ink passages 19 extends from manifold 18 to a uniquely corresponding nozzle 10 (see FIG. 6). As shown in FIGS. 2 and 3, passage unit 1 has cavity plate 3, base plate 4, first manifold plate 6, second manifold plate 7, and nozzle plate 9. These plates 3, 4, 6, 7, and 9 are stacked together. Each of these plates 3, 4, 6, 7, and 9 has an approximately rectangular shape having a thickness of between 50 μm and 150 μm. In the present embodiment, 42% nickel alloy steel plates are used for plates 3, 4, 6, and 7; and SUS430 is used for nozzle plate 9.

A plurality of pressurizing chamber holes 11*a* (see FIG. 3) is formed in a middle portion of cavity plate 3 in a transversal direction. These pressurizing chamber holes 11*a* are provided in two alternating rows in a longitudinal direction of cavity plate 3. Each of pressurizing chamber holes 11*a* forms a pressurizing chamber 11. Each of pressurizing chamber holes 11*a* is formed in approximately rectangular shapes. Rectangular pressurizing chamber holes 11*a* are positioned such that their longitudinal direction crosses the longitudinal direction of cavity plate 3. Depressions 11*b* are formed at a bottom surface of cavity plate 3. Each depression 11*b* is connected to uniquely corresponding pressurizing hole 11*a* at an end in the longitudinal direction of each pressurizing chamber hole 11*a*.

Cavity plate 3 has depression 17 having an elliptical shape at one end of cavity plate 3 in its longitudinal direction. A pair of depression holes 15*a* and 15*b* is formed on a bottom of depression 17. A filter (not shown in the drawings) for filtering the ink supplied from an ink tank (not shown in the drawings) is positioned in depression 17.

A plurality of first base plate holes 12*a* is formed in a middle portion of base plate 4 in the transversal direction. Hereafter, first base plate holes 12*a* are referred to as first BP holes 12*a*. These first BP holes 12*a* are provided in two alternating rows in the longitudinal direction of base plate 4.

Second base plate holes 13 arranged along a pair of rows in the longitudinal direction of base plate 4 are formed near the edges of base plate 4. Hereafter, second base plate holes 13 are referred to as second BP holes 13.

Third base plate holes 16*a* and 16*b* are formed at one end of base plate 4 in its longitudinal direction. Hereafter, third base plate holes 16*a* and 16*b* are referred to as third BP holes 16*a* and 16*b*. One of third BP hole 16*a* is provided at the position that corresponds to depression hole 15*a* of cavity plate 3. The other of third BP hole 16*b* is provided at the position that corresponds to depression hole 15*b* of cavity plate 3.

Elongated holes 6*a* and 6*b*, which extend in the longitudinal direction, are formed near the two longer edges of first manifold plate 6. Manifold depressions 7*a* and 7*b*, which extend in the longitudinal direction, are also formed near the two longer edges of second manifold plate 7. One end of elongated hole 6*a* and one end of manifold depression 7*a* are provided at the position that corresponds to third BP 16*a* of base plate 4. One end of elongated hole 6*b* and one end of manifold depression 7*b* are provided at the position that corresponds to third BP 16*b* of base plate 4.

The long portions of elongated holes 6*a* and 6*b* and the long portions of manifold depressions 7*a* and 7*b* are provided at the position that corresponds to each row of second BP holes 13 of base plate 4. As shown in FIG. 6, elongated hole 6*a* and manifold depression 7*a* form manifold 18 when first manifold plate 6 and second manifold plate 7 are bonded together. At the same time, elongated hole 6*b* and manifold depression 7*b* also form another manifold 18.

A plurality of first ink passage holes 12*b* is formed in the middle portion of first manifold plate 6 in its transversal direction. First ink passage holes 12*b* are distributed along longitudinal direction of first manifold plate 6. Each first ink passage hole 12*b* is disposed at the position uniquely corresponding one first BP hole 12*a* of base plate 4.

A plurality of second ink passage holes 12*c* is formed in the middle portion of second manifold plate 7 in its transversal direction. Second ink passage holes 12*c* are distributed along longitudinal direction of second manifold plate 7. Each second ink passage bole 12*c* is disposed at the position uniquely corresponding one first ink passage hole 12*b* of first manifold plate 6.

A plurality of nozzles 10 having tapered tips is formed in the middle portion of nozzle plate 9 in its transversal direction. Nozzles 10 are distributed along longitudinal direction of nozzle plate 9. Each nozzle 10 is disposed at the position uniquely corresponding one second ink passage hole 12*c* of second manifold plate 7.

The holes formed on the various plates, such as pressurizing chamber holes 11*a*, depression holes 15*a* and 15*b*, first BP holes 12*a*, first ink passage holes 12*b*, and second ink passage holes 12*c*, penetrate the each plate in the thickness direction. In other words, the holes formed in these plates penetrate the corresponding plate in the stacking direction.

As shown in FIGS. 4 and 6, water-repellent film 92 consisting of nickel plating or the like containing a fluoride-based polymer, such as polytetrafluoroethylene (PTFE), is formed on ink-discharging surface 9*b* of nozzle plate 9. This configuration prevents the ink discharged from nozzle 10 from adhering to the perimeter of nozzle 10 on ink-discharging surface 9*b* and interfering with the ink that is discharged next to worsen the impact characteristics of the ink on the printing medium.

With such a configuration, elongated hole 6*a* of first manifold plate 6 and manifold depression 7*a* of second manifold plate 7 form manifold 18 inside passage unit 1, as shown in FIG. 6. Likewise, elongated hole 6*b* of first manifold plate 6 and manifold depression 7*b* of second manifold plate 7 form another manifold 18. A purity of ink passages 19 is formed, each of which extends from manifold 18 to one corresponding nozzle 10 via one corresponding second BP hole 13, one corresponding depression 11*b*, one corresponding pressurizing hole 11*a*, and one corresponding passage 12 composed one corresponding first BP hole 12*a*, one corresponding first ink passage hole 12*b*, and one corresponding second ink passage hole 12*c*.

Figure 5:
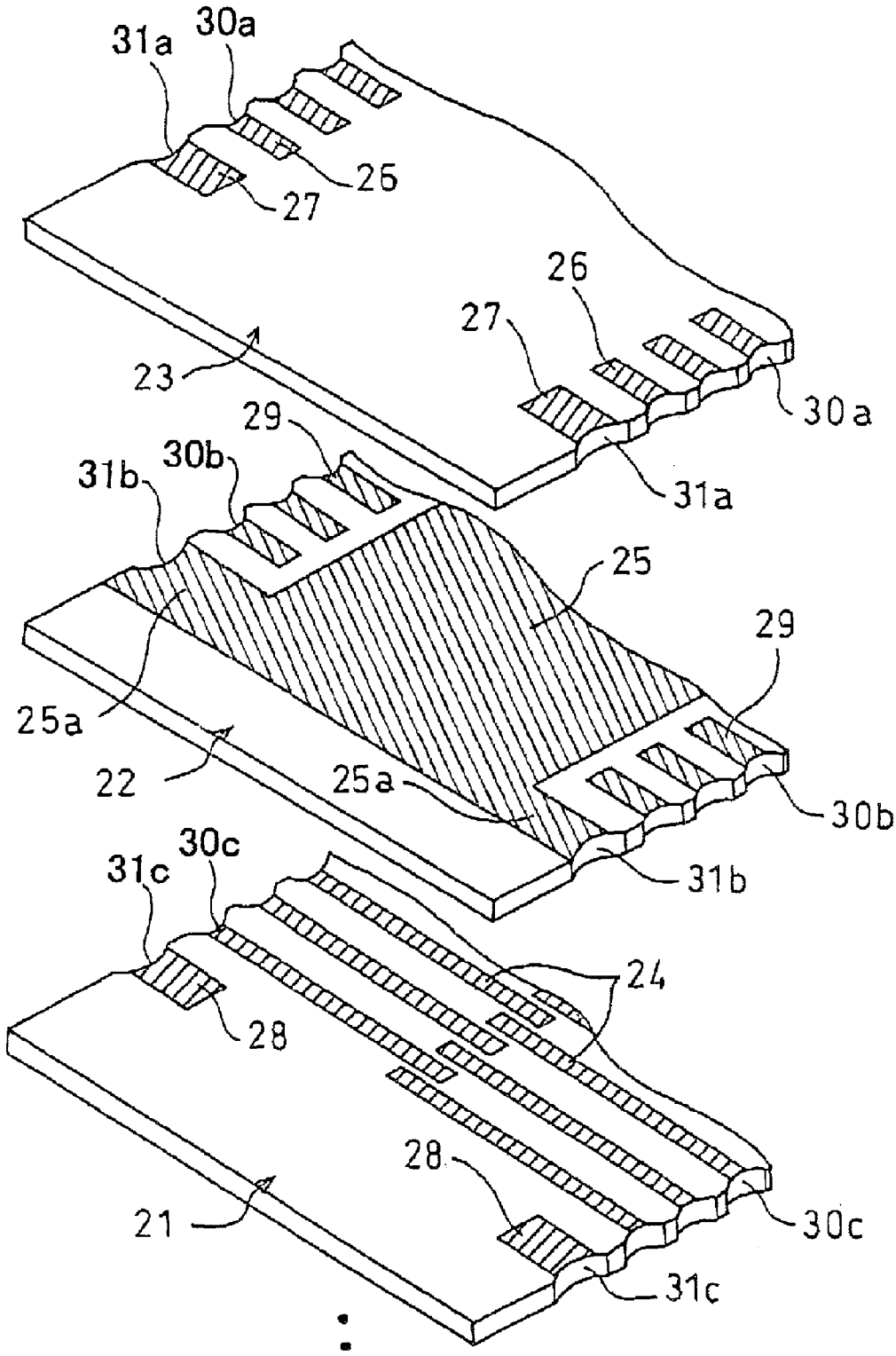
FIG. 5 is a partial exploded perspective view of an actuator unit of the inkjet head in the embodiment.

Next, actuator unit 2 will be explained, referencing FIGS. 5 and 6. FIG. 5 is a partial exploded perspective view of actuator unit 2. As shown in FIG. 6, actuator unit 2 is provided with two first piezoelectric sheets 21, two second piezoelectric sheets 22, and top sheet 23. Two first piezoelectric sheets 21 and two second piezoelectric sheets 22 are alternately stacked. Top sheet 23 is stacked on top of stacked first piezoelectric sheets 21 and second piezoelectric sheets 22. Of two first piezoelectric sheets 21, the one stacked on the lower side is not shown in FIG. 5. Likewise, of two second piezoelectric sheets 22, the one stacked on the lower side is not shown in FIG. 5.

Top sheet 23 is a rectangular sheet member made of an insulating material. Top sheet 23 has a plurality of connection terminals 26, each of which is to be connected to one corresponding signal electrode (not shown in the drawings) provided in flexible flat cable 40. Top sheet 23 also has a plurality of connection terminals 27, each of which is to be connected to grounding electrodes (not shown in the drawings) provided in flexible flat cable 40. Connection terminals 26 are positioned in the longitudinal direction along the two longer edges of top sheet 23. Connection terminals 27 are positioned at both ends of the rows of connection terminals 26. First side grooves 30*a*, each of which extends in the thickness direction, are formed on a side surface that is perpendicular to connection terminals 26 of top sheet 23. Additionally, second side grooves 31*a*, each of which extends in the thickness direction, are formed on a side surface that is perpendicular to connection terminals 27 of top sheet 23. One end of each connection terminal 26 is positioned such that it is exposed to one corresponding first side groove 30*a*. One end of each connection terminal 27 is positioned such that it is exposed to one corresponding second side groove 31*a*.

Piezoelectric sheets 22 are rectangular sheet members made of lead zirconate titanate (PZT). Each piezoelectric sheet 22 has a plurality of dummy electrodes 29, each of which is to be electrically connected to one corresponding connection terminal 26. Each piezoelectric sheet 22 also has common electrode 25, which is to be electrically connected to connection terminals 27. Dummy electrodes 29 are positioned along the two longer edges of and on top of piezoelectric sheet 22 so as to correspond to connection terminals 26 of top sheet 23. Common electrode 25 is positioned to cover the middle area of piezoelectric sheet 22. Common electrode 25 has edge electrodes 25*a*. Edge electrodes 25*a* are positioned at both ends of the row of dummy electrodes 29 so as to correspond to connection terminals 27 of top sheet 23. Third side grooves 30*b*, each of which extends in the thickness direction, are formed on a side surface that is perpendicular to dummy electrodes 29 of piezoelectric sheet 22. Fourth side grooves 31*b*, each of which extends in the thickness direction, are formed on a side surface that is perpendicular to edge electrodes 25*a* of piezoelectric sheet 22. One end of each dummy electrode 29 is positioned such that it is exposed to one corresponding third side groove 30*b*. One end of each edge electrode 25*a* is positioned such that it is exposed to one corresponding fourth side groove 31*b*.

Piezoelectric sheets 21 are rectangular sheet members made of PZT. Each piezoelectric sheet 21 has a plurality of electrodes 24, each of which is to be electrically connected to one corresponding connection terminal 26. Furthermore, piezoelectric sheet 21 has dummy electrodes 28, each of which is to be electrically connected to one corresponding connection terminal 27. Electrodes 24 are positioned along the two longer edges of and on top of piezoelectric sheet 21 so as to correspond to connection terminals 26 of top sheet 23. Electrodes 24 extend to the middle portion of piezoelectric sheet 21 such that each electrode 24 is positioned to face corresponding one pressurizing chamber 11 of passage unit 1 (see FIG. 6). Dummy electrodes 28 are positioned at both ends of the row of electrodes 24 so as to correspond to connection terminals 27 of top sheet 23. Fifth side grooves 30*c*, each of which extends in the thickness direction, are formed on a side surface of piezoelectric sheet 21 that is perpendicular to electrodes 24. Sixth side grooves 31*c*, each of which extends in a thickness direction, are formed on the side surface of piezoelectric sheet 21 that is perpendicular to dummy electrodes 28. One end of each electrode 24 is positioned such that it is exposed to one corresponding fifth side groove 30*c*. One end of each dummy electrode 28 is positioned such that it is exposed to one corresponding sixth side groove 31*c*.

When two piezoelectric sheets 21, two piezoelectric sheets 22, and top sheet 23 are stacked together, each first side groove 30*a*, one corresponding third side groove 30*b*, and one corresponding fifth side groove 30*c* become integrated to form one corresponding side groove 30, which extends in the thickness direction along the side surface of actuator unit 2. Likewise, each second side groove 31*a*, one corresponding fourth side groove 31*b*, and one corresponding sixth side groove 31*c* become integrated to form one corresponding side groove 31, which extends in the thickness direction along the side surface of actuator unit 2.

Each of side grooves 30 and 31 is coated with a conductive paste (not shown in the drawings). The conductive paste applied to each side groove 30 electrically connects one corresponding dummy electrode 29 and one corresponding electrode 24 with one corresponding connection terminal 26. Likewise, the conductive paste applied to each side groove 31 electrically connects one corresponding connection terminal 27 and one corresponding edge electrode 25*a* with one corresponding dummy electrode 28.

Next, the operation of actuator unit 2 is explained. Piezoelectric sheets 21 and 22 are polarized in their thickness direction, that is, in the stacking direction. When a voltage is applied to piezoelectric sheets 21 and 22 in their polarized thickness direction, their thickness expands or contracts. That is, the thickness of piezoelectric sheets 21 and 22 in the stacking direction expands or contracts. Whether the thickness expands or contracts is determined by the direction of the voltage applied. Therefore, when a predetermined voltage is applied between common electrode 25 and one of electrodes 24, the parts of piezoelectric sheets 21 and 22 contacting selected electrode 24 expand or contract in the stacking direction. In the present embodiment, piezoelectric sheets 21 and 22 are stacked. Therefore, when the predetermined voltage is applied between common electrode 25 and one of electrodes 24, displacements generated by the thickness-direction expansion or contraction in the parts of piezoelectric sheets 21 and 22 corresponding to selected electrode 24 are additive.

For example, when a voltage is applied, in the direction that expands piezoelectric sheets 21 and 22 in their thickness direction, to a signal electrode (not shown in the drawings) of flexible flat cable 40 to which a predetermined connection terminal 26 of top sheet 23 is connected, the parts of piezoelectric sheets 21 and 22 corresponding to electrode 24 electrically connected to the predetermined connection terminal 26 expand in the thickness direction. As shown in FIG. 6, the bottom surface of bottom-most piezoelectric sheet 21 is secured to the top surface of cavity plate 3, which defines pressurizing chambers 11. Therefore, piezoelectric sheets 21 and 22 deform at that parts so as to protrude into one of pressurizing chambers 11 located at a position corresponding to one of electrodes 24 electrically connected to the predetermined connection terminal 26. Consequently, the volume of the one of pressurizing chambers 11 located at the position corresponding to the one of electrodes 24 decreases, raising the pressure of the ink inside the one of pressurizing chambers 11. As a result, the ink is discharged from corresponding nozzle 10 connected to the one of pressurizing chambers 11. Subsequently, returning the one of electrodes 24 to the same potential as common electrode 25 returns piezoelectric sheets 21 and 22 to their original shapes, thus returning the volume of the one of pressurizing chambers 11 to its original size. As a result, ink is sucked into the one of pressurizing chambers 11 from manifold 18.

By controlling the voltage to be applied to each signal electrode (not shown in the drawings) of flexible flat cable 40 to which one corresponding connection terminal 26 of top sheet 23 is connected, it is possible to control ink discharging operation independently for each nozzle 10. It is possible to discharge irk from any selected nozzle 10 to draw desired letters or pictures on a printing medium.

Figure 7:
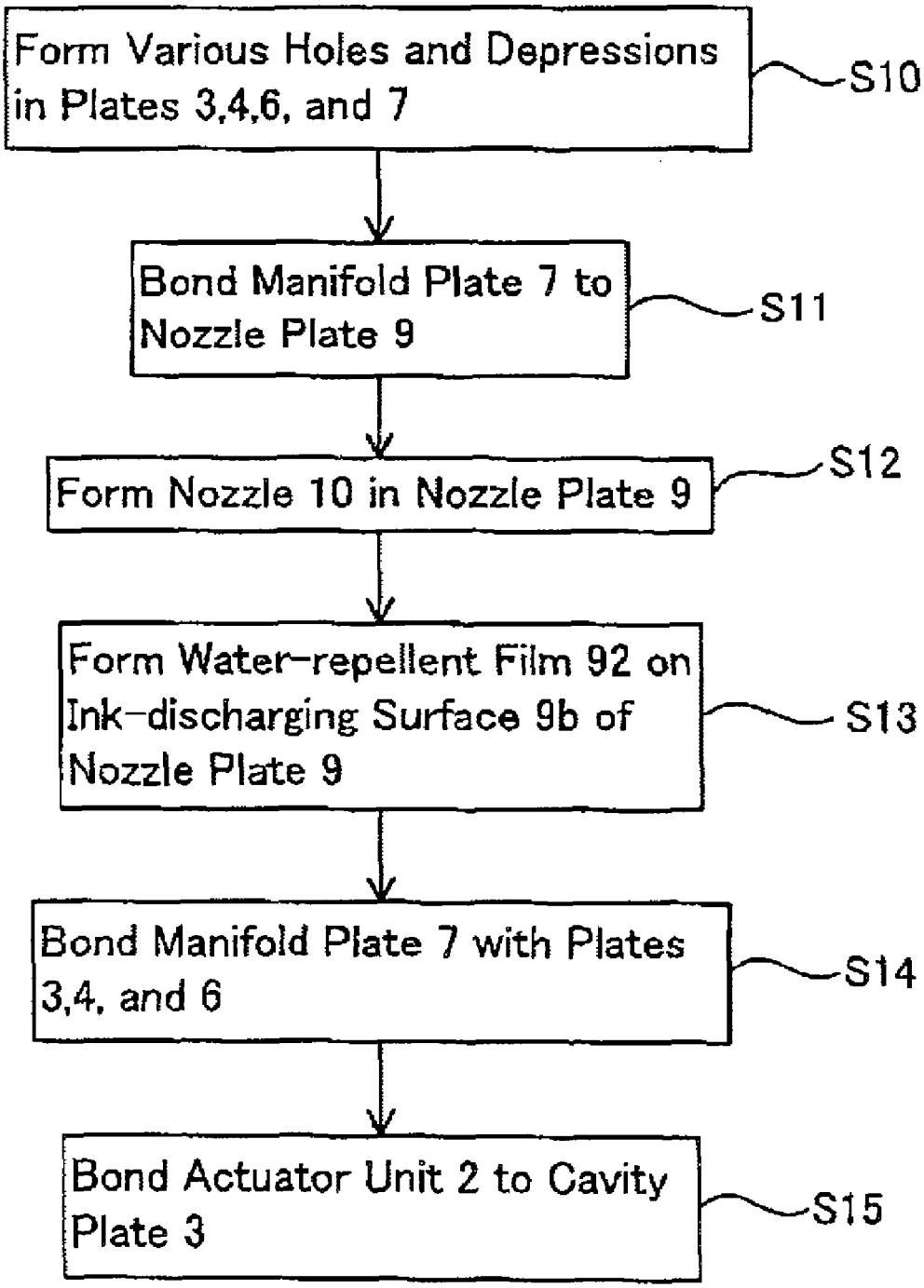
FIG. 7 shows a flowchart of an inkjet head manufacturing method in the embodiment FIG. 8 (*a*) through (*c*) show a nozzle forming processes.
Figure 8:
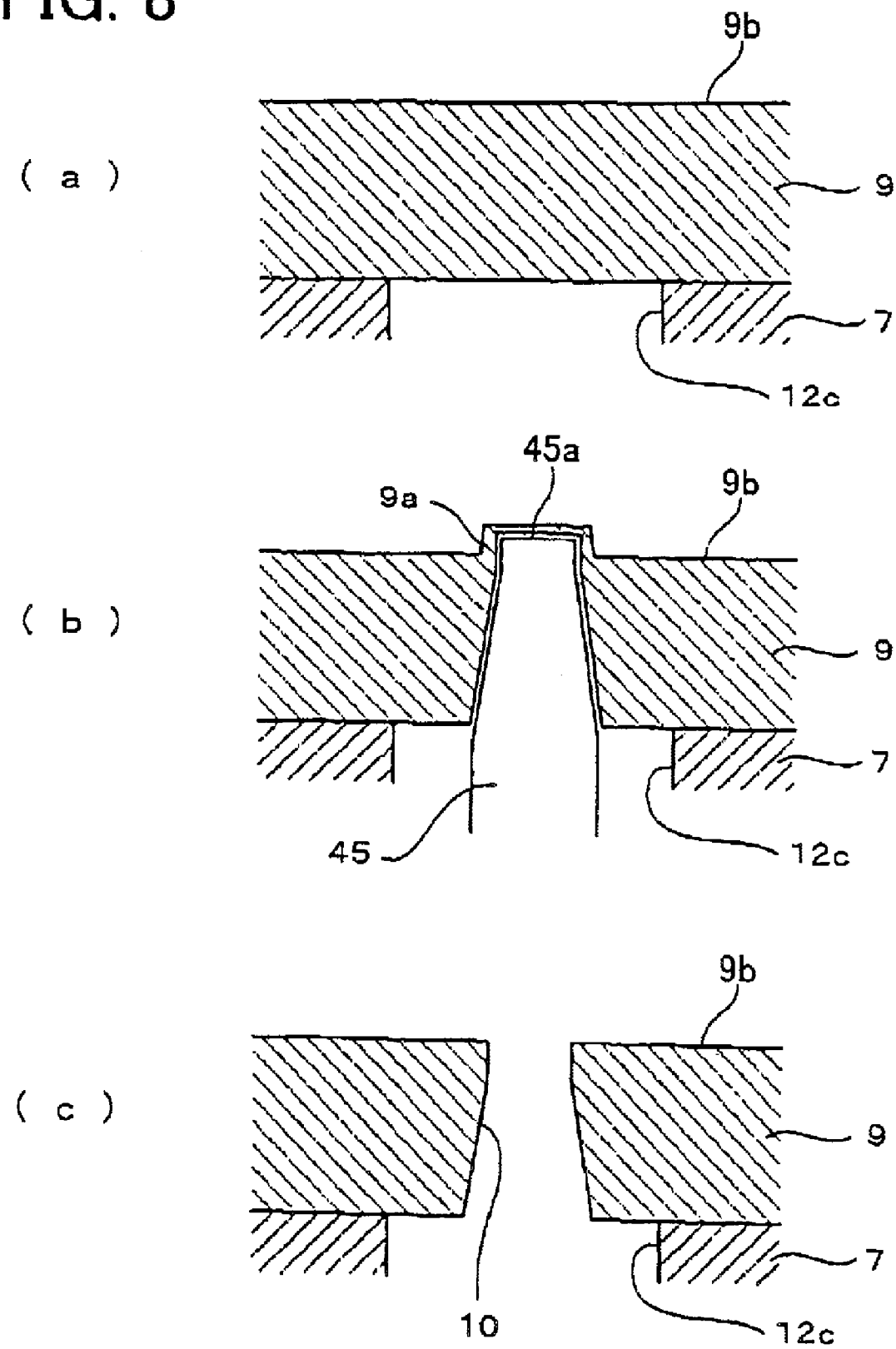
FIG. 8 (*a*) shows a process of bonding a surface of the nozzle plate to a surface of a second manifold plate.
Figure 9:
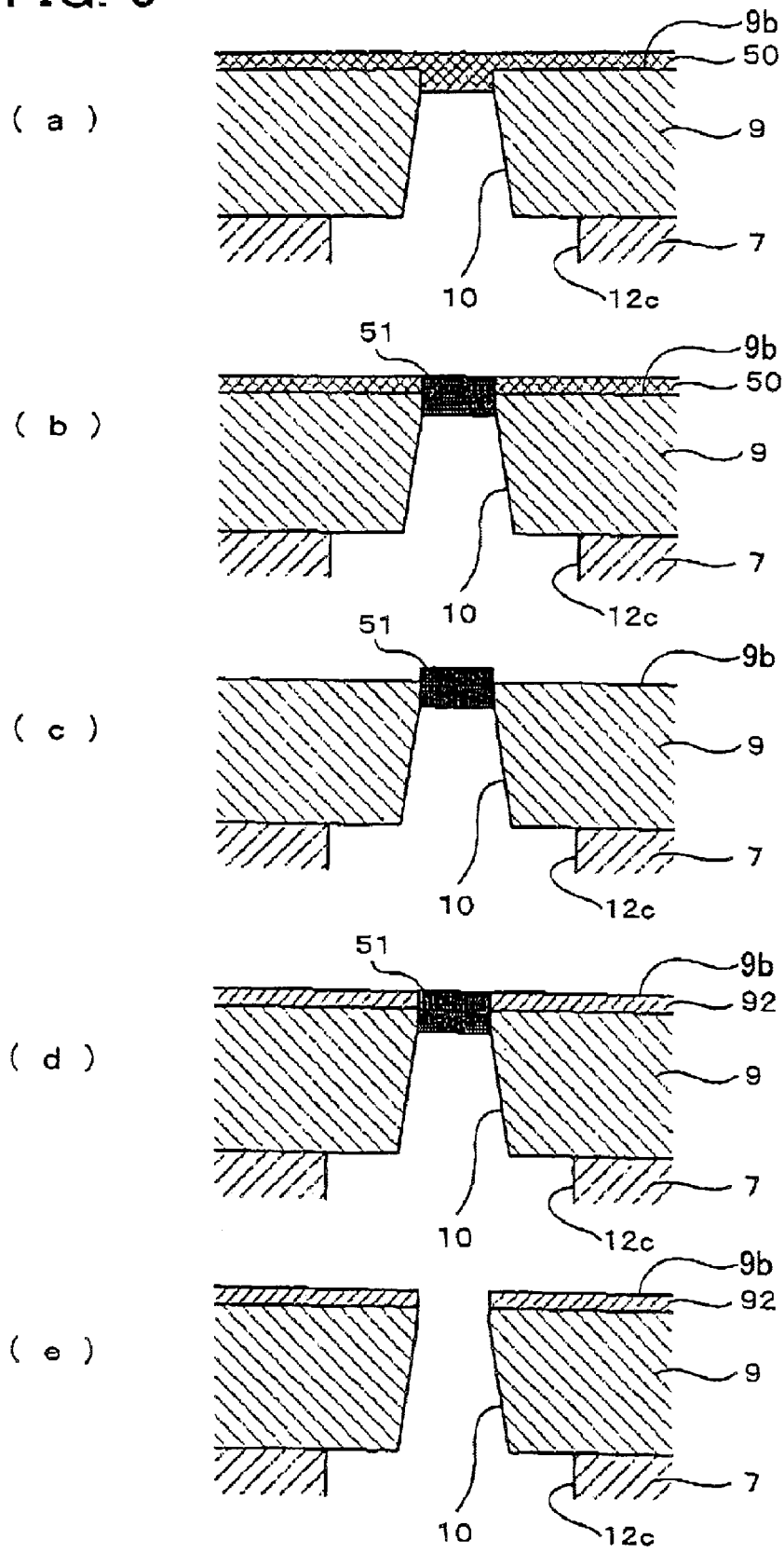
FIG. 9 (*a*) through (*e*) show processes of forming a water-repellent film.

Next, the method of manufacturing inkjet head 101 will be explained, referencing the flowchart in FIG. 7 as well as FIGS. 8 and 9. S1i (where i=0, 1, . . . , 5) in FIG. 7 indicates each process in the inkjet manufacturing method. FIG. 8 shows a process of forming a nozzle 10 on nozzle plate 9. FIG. 9 shows a process of forming water-repellent film 92 on ink-discharging surface 9*b* of nozzle plate 9 in which nozzle 10 has been formed.

First, various holes and depressions are formed in metal plates 3, 4, 6 and 7 (S10). Pressurizing chamber holes 11*a*, depressions 11*b*, depression 17 and a pair of depression holes 15*a* and 15*b* are formed on cavity plate 3 by etching or punching process or the like. First BP holes 12*a*, second BP holes 13, and third BP holes 16*a*, 16*b* are formed on base plate 4 by etching or punching process or the like. First ink passage holes 12*b* and elongated holes 6*a*, 6*b* are formed on first manifold plate 6 by etching or punching process or the like. Second ink passage holes 12*c* and manifold depressions 7*a*, 7*b* are formed on second manifold plate 7 by etching or punching process or the like. Note that nozzles 10 are not formed in nozzle plate 9 in this process. As will be described below, nozzles 10 are formed after nozzle plate 9 and second manifold plate 7 are bonded together.

Next, one surface of nozzle plate 9 is bonded to the bottom surface of second manifold plate 7. In this step, if an adhesive is used to bond the surface of nozzle plate 9 to the bottom surface of second manifold plate 7, and if the two plates are bonded together after nozzles 10 have been formed, there is a possibility that the adhesive might flow into nozzles 10 or second ink passage holes 12*c* from the bonded surface. If the adhesive flows into nozzles 10 or second ink passage holes 12*c*, it may alter the diameter of nozzles 10 or second ink passage holes 12*c*, thereby lowering the print quality.

As shown in FIG. 8 (*a*), in this embodiment, the surface of nozzle plate 9 (the surface opposite to ink-discharging surface 9*b*) and the bottom surface of second manifold plate 7 are stacked together, and these metal plates 7 and 9 are bonded together by pressurizing them for 30 to 60 minutes at a predetermined temperature under a vacuum condition. Herein the predetermined temperature is preferably higher than a room temperature. The room temperature is typically about 25 Celsius degree. More preferably, the predetermined temperature is between 900 and 1,050 Celsius degree. Then, at the contact surface between nozzle plate 9 and second manifold plate 7, metal atoms diffuse into each other, bonding the surface of nozzle plate 9 with the bottom surface of second manifold plate 7 (S11). By bonding metal plates together by heating them to the predetermined temperature under a vacuum condition and pressurizing them in this way, they can withstand the processing temperature for a water-repellent film. Furthermore, his method can avoid the problem of excess adhesive from the contact surface flowing into second ink passage holes 12*c* when the two metal plates 7 and 9 are bonded together by an adhesive. In other words, the problem of lowered print quality due to alteration of the diameter of second ink passage holes 12*c* by the excess adhesive does not occur.

Next, a camera or the like is used to take a photographic image of second ink passage hole 12*c* of second manifold plate 7. Based on the captured image, punch 45 is set at a predetermined position. During this step, the center of punch 45 is aligned with the center of second ink passage hole 12*c* of second manifold plate 7. As shown in FIG. 8 (*b*), punch 45 has a shape that is narrower at its tip. The thinnest part of this tapered shape has cylindrically protruding tip 45*a*. Not shown in the drawings, the number of punches 45 is equal to the number of second ink passage holes 12*c* and a distributing pattern of punches 45 is same as the distributing pattern of second ink passage holes 12*c*.

Once punches 45 are set in the predetermined position, they are driven into nozzle plate 9 through second ink passage hole 12*c* of second manifold plate 7. During this step, each punch 45 is driven in such that its tip 45*a* goes past the plane of ink-discharging surface 9*b* but does not penetrate ink-discharging surface 9*b*. Ink-discharging surface 9*b* of nozzle plate 9 is the surface that is opposite to the contact surface between nozzle plate 9 and second manifold plate 7. In other words, the punches 45 are driven in so as not to break nozzle plate 9. Driving punches 45 into nozzle plate 9 form protrusions 9*a* in ink-discharging surface 9*b* of nozzle plate 9.

Next, punches 45 are withdrawn from nozzle plate 9. Then, protrusions 9*a* are removed by a known method, such as electrolytic polishing, fluid polishing, polishing by a lapping machine, magnetic polishing, and cleaning by low-frequency ultrasonic waves. Punches 45 have been driven in such that their tips 45*a* go past the plane of ink-discharging surface 9*b*. Therefore, removing the protrusions 9*a* forms throughholes having openings at ink-discharging surface 9*b*. Nozzles 10 are formed in nozzle plate 9 as shown in FIG. 8 (*c*).

Since each punch 45 has been driven into nozzle plate 9 through one corresponding ink passage hole 12*c* of second manifold plate 7, one end of nozzle 10 is communicated with one corresponding second ink passage hole 12*c* at the contact surface between second manifold plate 7 and nozzle plate 9. The other end of each nozzle 10 opens at ink-discharging surface 9*b* of nozzle plate 9. Lastly, ink-discharging surface 9*b* is planarized to finish nozzles 10 (S12).

In the nozzle-forming process in S12, punches 45 are driven in after the center of each punch 45 is aligned with the center of one corresponding ink passage hole 12*c* of second manifold plate 7. Therefore, no positional misalignment occurs between each formed throughhole, i.e., each nozzle 10, and one corresponding second ink passage hole 12*c* of second manifold plate 7. Furthermore, since nozzles 10 are formed through presswork by punches 45, the interior surface of nozzles 10 are smooth, making it possible to precisely form nozzles 10 having the predetermined diameter.

Each punch 45 is driven in such that its tip 45*a* goes past the plane of ink-discharging surface 9*b* but does not break ink-discharging surface 9*b*. Driving each punch 45, such that its tip 45*a* goes past the plane of ink-discharging surface 9*b*, forms protrusion 9*a* in ink-discharging surface 9*b* of nozzle plate 9. The surface facing tip 45*a* of each punch 45 inside protrusion 9*a* protrudes beyond ink-discharging surface 9*b*. Therefore, removing protrusions 9*a* can form nozzles 10 that open at ink-discharging surface 9*b*.

Punches 45 are driven in so as not to break ink-discharging surface 9*b*. If any of punches 45 breaks ink-discharging surface 9*b*, that is, if any of punches 45 goes through ink-discharging surface 9*b*, jaggies might be created in the perimeter of ink-discharging surface 9*b*. If jaggies are created in the perimeter of the opening made by any of punches 45 goes through ink-discharging surface 9*b*, there is a risk that jaggies might remain inside the opening even after protrusion 9*a* formed at ink-discharging surface 9*b* is removed. Driving punches 45 such that their tips do not go through ink-discharging surface 9*b* of nozzle plate 9 and simply removing protrusions 9*a* can form nozzles 10 in nozzle plate 9 they are smooth all the way to their opening at ink-discharging surface 9*b*.

Next, a process of forming water-repellent film 92 will be explained. First, as shown in FIG. 9 (*a*), a roller or the like is used to press photo-curing resin 50 as a resist film onto ink-discharging surface 9*b* while heat is being applied. During this step, a predetermined amount of photo-curing resin 50 enters the tip of nozzle 10. While photo-curing resin 50 is being pressed, heating temperature, pressure, roller speed, etc. are adjusted. Not shown in the drawings, the predetermined amount of photo-curing resin 50 enters each tip of nozzles 10, but in FIG. 9, the process of water-repellent film 92 will be explained around one of nozzles 10.

Next, as shown in FIG. 9 (*b*), UV laser or the like is radiated to photo-curing resin 50 on ink-discharging surface 9*b* through nozzle 10 from second manifold plate 7. Radiating the U laser or the like cures photo-curing resin 50 inside nozzle 10. Here, by adjusting the amount of light used for exposure, the light passing through nozzle 10 is used to cure photo-curing resin 50 only in the direction in which nozzle 10 extends. This process forms cylindrical cured portion 51 that partially protrudes from ink-discharging surface 9*b* side of nozzle plate 9 and has the same diameter as the internal diameter of opening of nozzle 10 at the side of ink-discharging surface.

Next, as shown in FIG. 9 (*c*), photo-curing resin 50 on ink-discharging surface 9*b* of nozzle plate 9 is dissolved and removed with a development solution such as 1% $Na_2CO_3$ (alkaline etching Solution), except for cylindrical cured portion 51. Cylindrical cured portion 51 is left such that it masks the opening of nozzle 10 and protrudes from ink-discharging surface 9*b* of nozzle plate 9.

Next, as shown in FIG. 9 (*d*), water-repellent film 92 consisting of nickel plating or the like containing a fluoride-based polymer, such as polytetrafluoroethylene (PTFE), is formed on ink-discharging surface 9*b* of the nozzle plate 9. The thickness of water-repellent film 92 is between 1 and 5 μm. Then, as shown in FIG. 9 (*e*), after forming of water-repellent film 92, cylindrical cured portion 51 is dissolved and removed with an etching solution such as 3% NaOH.

Then in order to stabilize water-repellent film 92, it is heat-treated at 320 to 390° C., for example, for 15 to 40 minutes. If nozzle plate 9 and second manifold plate 7 are bonded together with an epoxy-based adhesive, the adhesive's maximum temperature tolerance is between 130 and 150° C., which is lower than that of water-repellent film 92. Therefore, heat-treating water-repellent film 92 after bonding would destroy the adhesive. However, in the present embodiment, nozzle plate 9 and second manifold plate 7 are bonded together by pressurizing them at the predetermined temperature under the vacuum condition. Therefore, water-repellent film 92 can be formed and heat-treated after nozzle plate 9 and second manifold plate 7 are bonded together. Water-repellent film 92 is formed after nozzle plate 9 and second manifold plate 7 are bonded together. Although the maximum temperature tolerance of water-repellent film 92 is between 320 and 390° C., which is lower than the temperature used for bonding nozzle plate 9 and second manifold plate 7 (approximately 950° C.), there is no risk that heating for bonding would destroy water-repellent film 92. In this way, water-repellent film 92 is formed on ink-discharging surface 9*b* of nozzle plate 9 (S13).

Next, cavity plate 3, base plate 4, first manifold plate 6, and second manifold plate 7 are aligned and stacked via an epoxy-based thermohardening adhesive or the like. Then, plates 3, 4, 6, and 7 are pressurized while being heated to a temperature that is higher than the curing temperature of the thermohardening adhesive, and are bonded together (S14).

During this step, plates 3, 4, 6, and 7 are aligned such that depression hole 14 *a*, third BP hole 16*a* of base plate 4, one end of elongated hole 6*a* of first manifold plate 6 and one end of manifold depression 7*a* of second manifold plate 7 correspond with each other.

Likewise, plates 3, 4, 6, and 7 are aligned such that depression hole 15*b*, third BP hole 16*b* of base plate 4, one end of elongated hole 6*b* of first manifold plate 6 and one end of manifold depression 7*b* of second manifold plate 7 correspond with each other.

Likewise, plates 3, 4, 6, and 7 are aligned such that each of pressurizing chamber holes 11*a* of cavity plate 3, one corresponding first BP hole 12*a* of base plate 4, one corresponding first ink passage hole 12*b* of first manifold plate 6 and one corresponding second ink passage hole 12*c* of second manifold plate 7 correspond with each other.

Likewise, plates 3,4,6 and 7 are aligned such that each of depression 11*b* of cavity plate 3, one corresponding first BP hole 13 of base plate 4, one corresponding elongated hole 6*a* or 6*b* of first manifold plate 6 and one corresponding manifold depression 7*a* or 7*b* of second manifold plate 7 corresponding with each other.

Next, passage unit 1 and actuator unit 2 are stacked via a thermohardening adhesive or the like. During this step, these units are aligned such that each electrode 24 is located at a position uniquely corresponding one pressurizing chamber 11. Then, passage unit 1 and actuator unit 2 are pressurized while being heated to a temperature that is higher than the curing temperature of the thermohardening adhesive, and are bonded together (S15). In this way, inkjet head 101 is completed.

The inkjet head manufacturing method explained above provides the effects described below.

A throughhole, i.e., nozzle 10, is formed in nozzle plate 9 after nozzle plate 9 (second plate) is bonded to second manifold plate 7 (first plate) having second ink passage hole 12*c* in the thickness direction. This makes it possible to form nozzle 10 while checking the position of second ink passage hole 12*c* of second manifold plate 7. Therefore, misalignment between nozzle 10 and second ink passage hole 12*c* can be prevented. Furthermore, because punch 45 is used to form nozzle 10, the interior surface of nozzle 10 can be made smooth. As a result, nozzle 10 with a predetermined diameter can be precisely formed.

Additionally, since nozzle plate 9 and manifold plate 7 are bonded together by pressurizing them at a predetermined temperature under a vacuum condition, they can withstand temperature for forming water-repellent film 92. Furthermore, the method according to the present invention can avoid the problem of excess adhesive from the contact surface flowing into nozzle 10 or second ink passage hole 12*c* when the two plates are bonded together by an adhesive after nozzle 10 has been formed, and lowering print quality by altering diameter of nozzle 10 or second ink passage hole 12*c*.

Furthermore, since the water-repellent film 92 is formed on ink-discharging surface 9*b* of nozzle plate 9 after nozzle plate 9 and second manifold plate 7 are bonded together, the predetermined temperature for bonding these plates will not destroy water-repellent film 92.

Next, a modified example of the present embodiment is explained.

After second manifold plate 7 and nozzle plate 9 are bonded together, it is possible to form nozzle 10 by etching nozzle plate 9 or radiating laser light to nozzle plate 9.

It is also possible to form a water-repellent film on ink-discharging surface 9*b* of nozzle plate 9 by coating ink-discharging surface 9*b* with a fluorine- or silicon-based resin solution. In this case also, the sane heat treatment, as in the present embodiment, is applied after the resin is applied to ink-discharging surface 9*b*, in order to stabilize the water-repellent film. It is also possible to irradiate ink-discharging surface 9*b* with an electron beam or laser beam to change ink-discharging surface 9*b* into an amorphous state and then rapid-cooling it to solidify it while maintaining this amorphous state, thereby forming the water-repellent film consisting of an amorphous layer on ink-discharging surface 9*b*. When the water-repellent film is formed through electron beam or laser beam irradiation, this water-repellent film is not destroyed by the predetermined temperature (approximately 950° C.) for bonding nozzle plate 9 and second manifold plate 7. Therefore, it is also possible to form the water-repellent film on ink-discharging surface 9*b* of nozzle plate 9 before bonding nozzle plate 9 and second manifold plate 7.

Whereas plates 3, 4, and 6 are bonded together by an adhesive in the embodiment, it is also possible to bond some or all of plates 3, 4, and 6 by pressurizing them at a predetermined temperature under a vacuum condition. Furthermore, whereas only two plates, i.e., nozzle plate 9 and second manifold plate 7, are bonded together at once in the embodiment, it is also possible to bond some or all of plates 3, 4, and 6 at the same time of bonding nozzle plate 9 and second manifold plate 7, and then to form nozzle 10 on nozzle plate 9.

The illustrated embodiment has been set forth in detail only for the purposes of clarity and example and should not be taken as limiting the invention as defined by the claims, which include the aforementioned examples and other examples later modified or changed.

Furthermore, the technical elements explained in the specification or drawings, provide technical utility by themselves or in various combinations and are not limited to the combinations described in the claims in the patent application. Additionally, the techniques presented as examples in the Specification or drawings are designed to achieve multiple purposes simultaneously and provide technical utility by achieving even one of these purposes.

What is claimed is:

1. A method of manufacturing an inkjet head, comprising:

a step of bonding a surface of a first plate having an ink passage hole penetrating the first plate, to a surface of a second plate by pressurizing a stack of the first plate and the second plate in a thickness direction at a predetermined temperature that is between 900 degrees Celsius and 1050 degrees Celsius;

a step of forming a throughhole penetrating the second plate, that is performed subsequent to bonding the first plate and the second plate, wherein the throughhole is communicated with the ink passage hole at a contact face between the first plate and the second plate and opens at an ink-discharging surface that is opposite the contact face;

a step of forming a water-repellent film on the ink-discharging surface, that is performed subsequent to forming the throughhole; and a step of heat-treating the formed water-repellant film for stabilization.

2. The method as in claim 1, wherein the water-repellent film is formed of a material whose maximum temperature tolerance is lower than the predetermined temperature.

3. The method as in claim 1, wherein the throughhole forming step comprises:

a step of driving a punch into the second plate through the ink passage hole until the tip of the punch proceeds beyond the ink-discharging surface but does not break the second plate so that a protrusion is formed at the ink-discharging surface; and a step of removing the protrusion formed at the ink-discharging surface, whereby the throughhole is formed.

4. The method as in claim 3, wherein the water-repellent film is formed of a martial whose maximum temperature tolerance is lower than the predetermined temperature.

5. The method as in claim 3, wherein each of the first plate and the second plate is made of metal.

6. The method as in claim 1, wherein each of the first plate and the second plate is made of metal.

* * * * *